US008268236B2

(12) United States Patent
Terehhov

(10) Patent No.: US 8,268,236 B2
(45) Date of Patent: Sep. 18, 2012

(54) ALUMINUM-BASED MASTER ALLOY FOR MANGANESE ALLOYING OF METAL ALLOYS, METHOD FOR PRODUCING THEREOF AND USE THEREOF

(76) Inventor: Mihhail Terehhov, Tallinn (EE)

( * ) Notice: Subject to any disclaimer, the term of this patent is extended or adjusted under 35 U.S.C. 154(b) by 0 days.

(21) Appl. No.: 12/802,600

(22) Filed: Jun. 10, 2010

(65) Prior Publication Data

US 2010/0313712 A1 Dec. 16, 2010

Related U.S. Application Data

(63) Continuation-in-part of application No. PCT/EE2008/000017, filed on Jun. 16, 2008.

(30) Foreign Application Priority Data

Dec. 14, 2007 (EE) ..... 200700059

(51) Int. Cl.
*C22C 1/03* (2006.01)
*C22C 22/00* (2006.01)

(52) U.S. Cl. ..... 420/434; 75/684; 420/590; 148/538; 164/122

(58) Field of Classification Search ..... 75/684; 420/434, 590; 164/122; 148/538
See application file for complete search history.

(56) References Cited

U.S. PATENT DOCUMENTS 3,592,637 A 7/1971 Brown et al.
3,788,839 A 1/1974 Faunce
4,171,215 A 10/1979 Dremann

FOREIGN PATENT DOCUMENTS

EP 1 489 161 A1 12/2004

OTHER PUBLICATIONS

George T. Campbell et al; "New Generation Manganese Additive for the Cast Shop—85% Manganese ALTAB HC"; Light Metals ; 1994; pp. 1093-1097; ISSN: 0147-0809.
Europe Community Standard CEN/TC 132 "Aluminum and aluminum alloys—Master alloys produced by melting—Specifications" (directive No. 97/23/EC), ratification date Mar. 6, 1995.
DIN EN 575 (1995).

*Primary Examiner* — George Wyszomierski
*Assistant Examiner* — Tima M McGuthry Banks
(74) *Attorney, Agent, or Firm* — Mihhail Terehhov

(57) ABSTRACT

The invention concerns an aluminum-based master alloy for manganese alloying of metal alloys and a method for producing thereof, and use thereof for production of the metal alloys. The master alloy is aluminum and manganese (Al—Mn) alloy in form of splatters, which contains the following components in mass %: Mn 77-93, other components in total 0-5, Al—the rest. The method for producing the master alloy is characterized in that the temperature for adding the manganese to the liquid metal is in the range from 660 to 1600° C., and the cooling rate of the alloy during casting is in the range of 50-1500° C./sec for obtaining splatters of the master alloy. Thickness of splatters is in the range of 1-10 mm. The master alloys AlMn80 and AlMn90 are designed to be used for manganese alloying of metal alloys, whereas the temperature for adding the master alloy in the liquid metal is in the range from 600 to 850° C. Master alloy and the method according to the invention provides high concentration of manganese in the master alloy, high dissolution rate of the master alloy in the liquid metal and high recovery degree of master alloy when used for alloying metals.

10 Claims, 1 Drawing Sheet

ALUMINUM-BASED MASTER ALLOY FOR MANGANESE ALLOYING OF METAL ALLOYS, METHOD FOR PRODUCING THEREOF AND USE THEREOF

This application is a Continuation-in-Part application of International Application PCT/EE2008/000017 filed 16 Jun. 2008 which claims the priority of Estonian Application P200700059 filed 14 Dec. 2007; which are hereby incorporated by reference.

TECHNICAL FIELD

The invention relates to the field of non-ferrous metallurgy, in particular to the aluminum-based master alloy for manganese alloying of metal alloys and the method for producing thereof, as well as the use thereof for production of the alloyed metal alloys.

BACKGROUND ART

The alloying additions for manganese alloying of metal alloys, containing manganese as a basic alloying element and aluminum as a base, are well known. Increase of alloying element content in alloying addition is a topical problem, as it permits to use less material for alloying. When using the alloying addition for alloy production, the alloying addition should provide high Mn dissolution rate and high Mn recovery degree in the alloy and, eventually, should guarantee the required content of Mn in the final product.

Alloying additions containing Mn are known as master alloys, in the form of Al—Mn alloy, as well as in the form of pressed briquettes and tablets.

Well known is the method for producing of alloying addition in the form of Mn and Al briquette for alloying of aluminum alloys (SU 1772194, A. N. Malenkikh et al., Int. Cl. C22B 9/10, 30.10.1992). The method includes pressing the mixture of crushed Mn or Mn compound (55-65%), refining flux (5-9%) and crushed in chips aluminum or Al alloys (30-36%). The alloying addition produced this way has the following deficiencies: low content of Mn, low Mn recovery degree, considerable losses of Mn and Al, high content of hydrogen and Na, oxides and other non-metallic impurities, which contributes to undesirable slag formation.

Well known are the alloying additions containing Mn and Al, in the form of pressed tablets (hereafter referred to as "tablets") Mn75, Mn80. The Mn80 tablets are produced by pressing of powder mixture containing 80% Mn and 20% Al and sometimes fluxes (MgCl, NaCl, etc.) The Mn80 tablets are applicable for alloying aluminum alloys with Mn and ensure the high Mn dissolution rate in aluminum melt and the high Mn content in the finished alloy. The shortcoming of the Mn80 tablets is the low recovery degree of Mn in the alloy and increased slag formation during alloying, caused by the high content of oxygen (up to 2%) in the alloy in the form of Mn oxides and hydroxides and Al oxides available on the surface of metal particles in the briquette. The slag formation causes high impurity and lower quality of final product, increased losses of aluminum, clogging of furnaces, channels and electromagnetic pumps (hereafter referred to as "EMP"), and as a result, the depreciation of equipment. All this, in the aggregate, leads up to the increase of production cost of alloyed Al alloy.

Are also known the master alloys in the form of Al—Mn alloys, for example, master alloy AlMn20 containing 20% Mn and 80% Al, and further created master alloy AlMn60 containing 60% Mn and 40% Al.

The nearest to the present invention technical solution is a known master alloy AlMn60 (EN AM-AlMn60), which contains 40% Al, 60% Mn and other components too, and is made in the form of splatters, according to the Europe Community Standard *CEN/TC* 132 *"Aluminium and aluminium alloys—Master alloys produced by melting—Specifications"* (directive No. 97/23/EC), cite EN 575:1995, ratification date Jun. 3, 1995. The known master alloy is produced by a known method, according to which Al is loaded into furnace, melts and is heated to a specified temperature. After that, the temperature being maintained, the rated amount of Mn and other components is added in the melt portion-wise. The obtained melt comes to homogeneous state, is being held during the time and, once the prescribed content of components is reached, the casting of the obtained alloy occurs with cooling, thus forming the splatters (the splatters of the alloy mean the alloy in form of "flake") of the alloy. The known method includes the heating of Al up to 1300° C., and the casting is to be done, after the Mn content in the melt has reached 60%, with forming splatters of the master alloy with thickness of 2-5 mm. This master alloy is used for alloying Al alloys. The master alloy has the crystal structure in which during rapid heating, in the process of alloying, under the temperature in the range of 540-570° C. directed phase transformations arise followed by the volume increase. This creates the internal stresses in the crystal lattice, which break down the master alloy into small particles having size of 100-400μ, thus bringing the master alloy to decomposition and causing Mn dissolution in the melt. The deficiency of the known master alloy AlMn60 is the low content of Mn (not more than 60%) and, as a result, the higher expense of the master alloy for a unit of the final product and consequently the high cost of the master alloy in terms of 1 kg of Mn. Also, this master alloy has the low dissolution rate during alloying.

Thus, no high-performance master alloy for alloying metal alloys with Mn is known from the background art, which master alloy would have high Mn content and would guarantee high Mn dissolution rate in the melt, as well as high Mn recovery degree in the alloy, without producing slag formation which effects negatively the quality of the alloy.

The object of the present invention is to eliminate the above mentioned deficiencies and to create a new high-performance master alloy for Mn alloying of metal alloys and a new method for producing the master alloy, which would guarantee the high content of Mn, high Mn dissolution rate in the melt and high Mn recovery degree in the alloy without slag formation and contamination of metal alloy, when using the master alloy for production of alloys.

SUBJECT OF THE INVENTION

One object of the present invention is the aluminum-based master alloy for Mn alloying of metal alloys, wherein the master alloy comprises Al, Mn and optionally other components and is performed in the form of splatters and with phase transformations in the crystal structure at the alloying temperature; and wherein the master alloy is characterized in that the components of master alloy are as follows, in mass %:

Mn—77.0-93.0, other components, each 0-2.0, in total 0-5.0,

Al—the rest up to 100, and the alloying temperature is in the range of 600-850° C.

Preferably, the master alloy comprises of, in mass %:

Mn—77.0-93.0;

other components, incl. Fe and Si, each not more than 2.0, in total not more than 5.0, where Fe—not less than 0.01 and Si—not less than 0.01;

Al—rest up to 100;

and the alloying temperature is in the range of 600-850° C.

(Limitations Fe and Si were done on the basis of practical tests and alloy with these limitations had the best results.)

Preferably, the master alloy is proposed, which has the splatters thickness in the range of 1-10 mm. (Other sizes are not determined, but they—length and width—significantly greater than the thickness.)

The master alloy, according to the present invention, is proposed, which has the content of Mn in the range of 77-83% (hereinafter this master alloy is referred to as AlMn80). Also the master alloy, according to the present invention, is proposed, which has the content of Mn in the range of 87-93% (hereinafter this master alloy is referred to as AlMn90). Hereinafter the master alloy involving all possible versions of chemical composition of the master alloys within the scope of the claims, will be referred to as AlMn80(90).

Another object of the present invention is a method for producing aluminum-based master alloy for manganese alloying of metal alloys, which includes the steps of loading of Al into a furnace, melting and heating of Al to the needed temperature, adding the needed amount of Mn portion-wise and optionally other components into the melted Al under stirring, with the temperature being maintained, holding the melt to achieve homogeneity and the needed content of components, and casting of the liquid alloy in splatters form with cooling,—wherein, according to the invention, at the producing of master alloy, Al is heated up to 660-1600° C., casting is realized at the following content of components, mass %:

Mn—77.0-93.0, other components, each 0-2.0, in total 0-5.0,

Al—the rest up to 100, and the cooling rate during casting is maintained in the range of 50-800° C./mm·sec.

Preferably, the casting is realized at the following content of components of master alloy, mass %:

Mn—77.0-93.0;

other components, incl. Fe and Si, each not more than 2.0, in total not more than 5.0, where Fe—not less than 0.01 and Si—not less than 0.01;

Al—rest up to 100;

and the cooling rate during casting is maintained in the range of 50-800° C./mm·sec (eqv. 50-1500° C./sec)

To form the necessary microstructure of splatters of the master alloy, it is necessary that the cooling rate is provided for the whole mass of splatter in measurement unit of ° C./mm·sec, which is equivalent to the cooling rate of the surface of splatter in ° C./sec and the relation between the cooling rate of mass and cooling rate of surface was in our case determined experimentally. In our case the cooling rate of 50-800° C./mm·sec is equivalent to about of 50-1500° C./sec.

The master alloy, according to the invention, produced by the above method, can be used for manganese alloying of metal alloys, wherein the master alloy is added to the liquid metal at the temperature in the range of 600-850° C., which provides intensive phase transformations in the crystal structure of the added master alloy.

In case of using the master alloy for production of metal alloys, according to the invention, it is preferable, that the master alloy is being added to the liquid metal under stirring.

The master alloy, according to the invention, can be used for manganese alloying of the aluminum alloys.

Combination of the essential features of the present invention, according to the claims, enables to obtain a master alloy with high content of manganese, which has a crystal structure, where the directed phase transformations, arising at rapid heating during alloying (in the temperature range of 600-850° C.) and followed by increase of volume, proceed much more effectively and with larger amount of phase transformations centers than in case of the master alloy AlMn60. This leads to more effective decomposition of the master alloy during alloying of metal alloys. The particles arising at the decomposition of the master alloy have the size of 1-50μ, which is smaller, than in case of AlMn60, so they spread out in the melt faster and into a larger volume, which increases the Mn dissolution rate considerably, thus providing practically complete Mn recovery in the alloy. The master alloys AlMn80 (90), according to the invention, including the embodiments master alloy AlMn80 and master alloy AlMn(90), ensure more fast Mn dissolution in the melt in comparison with the known master alloy AlMn60. Thereto the master alloy AlMn80 dissolution rate is higher than that of the master alloy AlMn90.

Under the same conditions of adding the master alloy the dissolution rate of the master alloy, according to the invention, is 3-4 times higher than in case of the known master alloy AlMn60 (dissolution time is 5-25 min for the claimed master alloy AlMn80(90) and 20-100 min for the known master alloy). The amount of the master alloy added into the Al melt in order to reach the specified Mn concentration is 33% less using the master alloy AlMn80, and 50% less using the master alloy AlMn90, according to the invention, than in case of using the known master alloy AlMn60.

Moreover, the master alloy by the invention, which is obtained as master alloys AlMn80(90), surpasses the known alloying addition in the form of tablet Mn80 in content of the alloying element and has the same high Mn dissolution rate in the melt and considerably more high Mn recovery degree in the alloy, without slag formation and alloy contamination with non-metal impurities.

The present invention provides creation of the master alloy with high Mn content, high dissolution rate of Mn in the melt and high Mn recovery degree in the alloy, and thereto without slag formation. Consequently, the object of the present invention has been achieved.

As a whole, the master alloy, according to the invention, the method for producing thereof and the use thereof for production of alloyed metal alloys solve the problem of production of high quality, cost-effective manganese alloyed metal alloys, including the aluminum alloys.

DESCRIPTION OF DRAWING

The invention is being illustrated by the FIG. 1 and the detailed description of the examples of embodiments of the invention following below.

The FIG. 1 represents the graph of the dissolution rate of master alloys illustrating the experimental results for master alloys AlMn80 and AlMn90 according to the invention in comparison with the known alloying additions, namely master alloy AlMn60 and tablets Mn80 (compacts).

EXAMPLES OF EMBODIMENTS OF THE INVENTION

Figure 1:
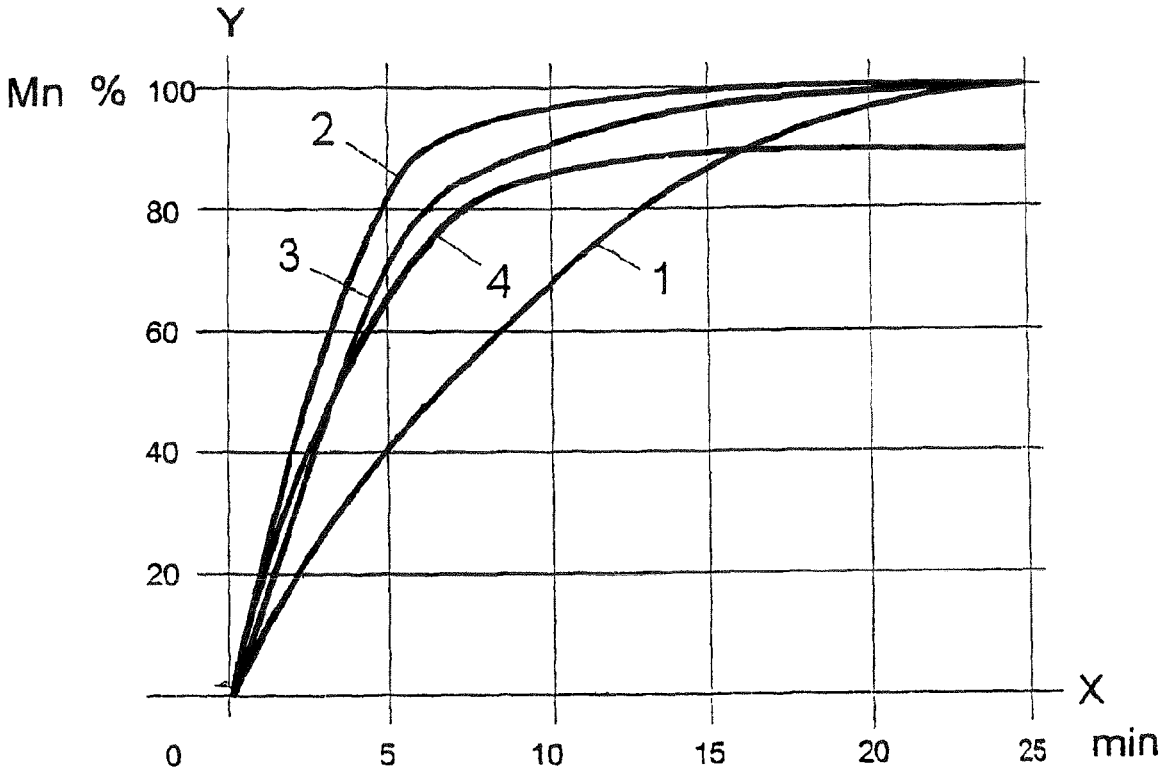

As an example of the embodiments of the invention the master alloys AlMn80 and AlMn90 are taken.

The content of components of the master alloys corresponds to the Table 1.

TABLE 1

| Designation of master alloy by the invention | Content of components (mass %) | | | | | |
|---|---|---|---|---|---|---|
| | | | | | Other components | |
| | Si | Fe | Mn | Al | each | in total |
| AlMn80 | 0.40 | 0.40 | 77.0-83.0 | the rest up to 100 | up to 0.3 | up to 1.0 |
| AlMn90 | 0.40 | 0.40 | 87.0-93.0 | the rest up to 100 | up to 0.3 | up to 1.0 |

The intensive directed phase transformations in the crystal lattice occur in the temperature range of 600-850° C.

The method for producing of the master alloy (according to the Table 1) is as follows:

The rated amount of aluminum based on the required amount of alloy to be produced, is loaded into the furnace (for example furnace IAT-2,5 Demidov Industries AS, Tallinn, Estonia). Al may be loaded in a liquid or solid state. Al gets heated to the needed temperature in the range of 660-1600° C., and with this temperature maintained the rated amount of Mn and other necessary components (in particular Fe, Si) are added portion-wise into the melted Al. Adding of Mn into the melted Al is carried out, preferably, under stirring. Stirring may be produced, for example, by a natural way under the influence of electromagnetic force of induction furnace. Then, the obtained melt is being held under this temperature during the time needed for Mn to be dissolved completely, so that the melt to achieve the homogeneous state and the needed content of components. After Mn dissolution the sample is taken to test the content of the components (the test is perform by analytical device—ARL Advant'XP, Thermo Electron Wissenscche Geräte Ges.m.b.H, Vienna, Austria), and when the required content of Mn is reached, the obtained melt is brought to the casting machine with a water-cooled copper table (CTCWC-2, Demidov Industries AS, Tallinn, Estonia), where the casting is carried out with the cooling rate of alloy in the range from 50 to 1500° C./sec ensured. During the casting the splatters of the master alloy are being formed, having the thickness in the range of 1-10 mm. According to this method the master alloy with the polycrystalline structure forms, which is capable of intense phase transformations with volume increase under the rapid heating up to the temperature in the range of 600-850° C., when this master alloy is used for production of alloyed metal alloys.

Method of use of the master alloy, according to the invention, for production of the manganese alloyed metal alloys, in particular, the aluminum alloys, is as follows:

The rated amount of Al is loaded into the furnace. Al gets heated up to the temperature in the range of 600-850° C. Then, the rated amount of master alloy AlMn80 or master alloy AlMn90, according to the invention, based on the required amount of Mn in the final alloy is added into the melt. It is preferable to add the master alloy into the stirring zone. After that the melt is being held to achieve the homogeneity and the required content of components in the whole volume of melt in the furnace. To check-up the chemical content of the melt, the analysis of Mn concentration is done, the samples being taken in each 10-45 minutes, depending on the technology. Once the required concentration of Mn is reached, the successive alloy processing is performed according to the chosen technology. The master alloy dissolution proceeds moderately, without rise of temperature, gas emission and slag formation. If stirred, the master alloy dissolves 3-4 times faster. For this production a gas reverberatory furnace (produced by the Demidov Industries AS, Tallinn, Estonia), with a volume of 16 tons, was used.

The high effectiveness of the master alloy received according to the present invention is confirmed by the results of the industrial tests. The industrial tests of the master alloys AlMn80 and AlMn90 according to the invention took place at Hydro Aluminum (Holmestrand, NO), RUSAI (Krasnoyarsk, RU), and also at some other plants. The tests were performed in comparison with the master alloy AlMn60 and the tablet Mn80, both known from the background art, by using them for manganese alloying of different metal alloys. The tests displayed the advantages of the master alloys AlMn80, AlMn90 compared to the known master alloy AlMn60 as well to the known tablets Mn80.

Different equipment was used for the tests:

induction channel furnaces;

gas reverberatory furnaces with EMP pumps;

gas reverberatory furnaces with mechanical stirring;

electric reverberatory furnaces.

Good results were achieved with all types of furnaces and different types of alloys.

Example of using the master alloy, according to the invention, for production of manganese alloyed aluminum alloys, in comparison with the alloying additions known from the background art The object of study was the Mn dissolution rate in Al melt and the Mn recovery degree in the alloy (i.e. the master alloy recovery degree). The master alloys, according to the invention (the master alloys AlMn80 and AlMn90), were compared with the alloying additions known from the background art (the master alloy AlMn60 and the tablet Mn80). The tests have been carried out under the same temperature of adding the alloying addition to the Al melt (720-730° C.) and in the same furnace.

Description of Experiment

1. Equipment

A crucible induction furnace (IAT-0,03 Demidov Industries AS, Tallinn, Estonia) capacity of 50 liters was used, measurements were performed with the K-type thermocouple.

2. Experiment Procedure 50 kg of primary aluminum was loaded into the crucible furnace; after Al was melted and the temperature of liquid Al 720-730° C. was obtained, the rated amount of various alloying additions, master alloys according to the invention and known master alloy and tablets, was added. For the master alloys AlMn80 and AlMn90 according to the invention and known master alloy AlMn60 and for the known tablet Mn80 the rated amount was correspondingly:

for AlMn60-0.833 kg for AlMn80-0.625 kg for AlMn90-0.556 kg for tablet Mn80-0.625 kg.

Before the master alloy addition the check sample was taken (from the melt to be alloyed). After the master alloy addition the samples have been taken every minute. After 30 samples taken, the analysis was done on the equipment ARL Advant'XP, Thermo Electron Wissenscche Geräte Ges.m.b.H, Vienna, Austria. On the grounds of the received data of Mn content in the melt, the graphs were made, where the results of the experiment for each of the alloying additions under study were presented. The point under consideration was the rate of Mn dissolution in the aluminum melt and the degree of Mn recovery in the alloy for each of the alloying additions under test. The results of the industrial tests are shown on the FIG. 1 and in the Table 2.

On the FIG. 1, which shows comparison of the dissolution rate of various alloying additions, the content of Mn in the melt being alloyed is represented as a function of Mn dissolution time for the master alloys AlMn80 and AlMn90, according to the invention, and for the known alloying additions (the master alloy AlMn60 and the tablet Mn80). On the axis X the time from the moment of adding the alloying addition to the aluminum melt is shown in minutes; on the axis Y the content of Mn in the melt is shown in % of the rated value of Mn content (the rated value of Mn relative content 1% in the melt—is taken for the 100% recovery). The received curves of increase of Mn content (i.e. dissolution rate) for each of the alloying additions under comparison, are marked on graph on the FIG. 1 as follows: item 1—known master alloy AlMn60, item 2—master alloy AlMn80 and item 3—master alloy AlMn90 (both according to the invention), item 4—known tablet Mn80.

The graph permits to evaluate the dissolution rate of Mn in the melt and the recovery degree of Mn in the alloy to be alloyed for each of the alloying additions under testing, other conditions being equal.

The graph on the FIG. 1 confirms that:

As to the dissolution rate, the master alloys AlMn80 and AlMn90 according to the invention are more efficient than the known tablets Mn80 and known master alloy AlMn60 alloy. The dissolution rate of master alloy AlMn80 being faster than that of AlMn90.

The recovery degree of Mn in the alloyed alloy makes 100% of the rated value in case of master alloys AlMn60 (known), AlMn80 and AlMn90, and approximately 90% in case of known tablet Mn80.

The feature <<cooling rate 50-1500° C./sec>> is not known from the Background art, and assures creation of the master alloy with the Mn content of 77-93%, according to the invention, having the improved properties, high recovery degree and high dissolution rate, which are better, than that of the known tablets Mn80.

In the Table 2 below the basic characteristics and parameters of the master alloys AlMn80(90) according to the invention, known master alloy AlMn60 and known tablet Mn80 being compared are shown in the way easy for comparison and in the qualitative mode, which permits to evaluate advantages and drawbacks of each of them, as well as their possible application.

TABLE 2

Comparison of characteristics of the master alloys AlMn80, AlMn90, according to the invention, and of the known master alloy AlMn60 and known tablet Mn80

| Comparative characteristics: | AlMn80 AlMn90 | AlMn60 | Mn80 (tablet) |
|---|---|---|---|
| Cost of initial material | + | +/− | + |
| Cost of Mn added, taking into account subject to losses and recovery degree | ++ | + | +/− |
| Dissolution rate of Mn in the melt | ++ | +* | ++ |
| Purity of the added material (gases, nonmetallic impurities) | ++ | ++ | −− |

TABLE 2-continued

Comparison of characteristics of the master alloys AlMn80, AlMn90, according to the invention, and of the known master alloy AlMn60 and known tablet Mn80

| Comparative characteristics: | AlMn80 AlMn90 | AlMn60 | Mn80 (tablet) |
|---|---|---|---|
| Degree of alloy contamination (effect produced on the quality of final product) | ++ | ++ | −− |
| Environmental effect | ++ | ++ | − |
| Depreciation of equipment | ++ | ++ | − |
| Slag formation | ++ | ++ | −− |
| Possibility of extended storage | + | + | − |
| Degree of Mn recovery in the alloy | ++ | ++ | − |
| Constancy of recovery parameters | ++ | ++ | − |

Remarks:
+ advantage
− shortcoming
*in case of metal circulation in the furnace the dissolution rate is similar to that of Mn80 tablets Advantages:

1. For the first time in the history of the master alloys the created master alloy—the alloy AlMn80(90) according to the present invention—surpasses the known alloying addition in the form of tablets Mn80 in alloying element concentration.
2. The created master alloy by the invention—the alloy AlMn80(90)—surpasses the known master alloy AlMn60 in dissolution rate and is equivalent to the known tablets Mn80.
3. The created master alloy—the alloy AlMn80(90) according to the present invention—is equivalent to the known master alloy AlMn60 in degree of Mn recovery in alloy and surpasses the known tablets Mn80.

INDUSTRIAL APPLICABILITY

The high-concentration master alloy AlMn80(90), according to the invention, is easy in use and storage. The master alloys AlMn80 and AlMn90 guarantee high economic parameters as well as high and steady quality of the final product, i.e. metal alloys, and could be widely used in non-ferrous metallurgy. According to the results of industrial tests, master alloys AlMn80 and AlMn90, according to the invention, could be widely and efficiently used for alloying of aluminum alloys as well as alloys of other metals.

Master alloys AlMn80 and AlMn90, according to the present invention, could be produced basing on the materials currently used and different types of nowadays equipment.

The possible embodiments of the present invention are not restricted to the above-mentioned examples. Other versions of embodiment are also possible within the scope of the claims.

The invention claimed is:

1. An aluminum-based master alloy for manganese alloying of metal alloys, wherein the master alloy is an aluminum-manganese alloy, comprising optionally of other components, wherein the master alloy is made in the form of splatters and with transformations in a crystal structure at an alloying temperature, wherein the master alloy comprises of, in mass %: Mn—77.0-93.0; other components, incl. Fe and Si, each not more than 2.0, in total not more than 5.0, where Fe—not less than 0.01 and Si—not less than 0.01; Al—rest up to 100; and the alloying temperature is in the range of 650-850° C. wherein the splatters have thickness in the range from 1 mm to 10 mm.

2. The master alloy according to claim 1, wherein master alloy comprises 77.0-83.0 mass % of Mn.

3. The master alloy according to claim 1 wherein master alloy comprises 87.0-93.0 mass % of Mn.

4. A method for producing an aluminum-based master alloy for Mn alloying of metal alloys, comprising the following steps:

loading of Al into a furnace, melting and heating Al to the needed temperature, adding Mn to the melt portion-wise and optionally other components, holding the melt to achieve a homogeneity and a needed content of components, and casting of the liquid alloy in a splatters form with cooling, wherein heating of Al is carried out to the temperature in the range of 660-1600° C., casting is realized at the following content of components, in mass %: Mn—77.0-93.0; other components, incl. Fe and Si, each not more than 2.0, in total not more than 5.0, wherein Fe—not less than 0.01 and Si—not less than 0.01; Al—rest up to 100; and the alloy cooling rate during casting is being provided in the range of 50-1500.degree. C./sec.

5. A method for production of the aluminum-based metal alloys, wherein a master alloy according to the claim 1 is added to the liquid metal to be alloyed at the temperature in the range of 600-850.degree. C.

6. The method according to the claim 5, wherein the master alloy is added to liquid aluminum to form the aluminum alloys.

7. A method for production of the aluminum-based metal alloys, wherein a master alloy according to the claim 2 is added to the liquid metal to be alloyed at the temperature in the range of 600-850.degree. C.

8. The method according to the claim 7, wherein the master alloy is added to liquid aluminum to form the aluminum alloys.

9. A method for production of the aluminum-based metal alloys, wherein a master alloy according to the claim 3 is added to the liquid metal to be alloyed at the temperature in the range of 600-850.degree. C.

10. The method according to the claim 9, wherein the master alloy is added to liquid aluminum to form the aluminum alloys.

* * * * *